US006272968B1

(12) United States Patent
Ropponen

(10) Patent No.: US 6,272,968 B1
(45) Date of Patent: Aug. 14, 2001

(54) CONTROL SYSTEM FOR AN OSCILLATION CYLINDER

(75) Inventor: Vesa Ropponen, Punkalaidun (FI)

(73) Assignee: Polarteknik PMC Oy AB, Vantaa (FI)

( * ) Notice: Subject to any disclaimer, the term of this patent is extended or adjusted under 35 U.S.C. 154(b) by 0 days.

(21) Appl. No.: 09/402,221

(22) PCT Filed: Apr. 3, 1997

(86) PCT No.: PCT/FI97/00204

§ 371 Date: Oct. 1, 1999

§ 102(e) Date: Oct. 1, 1999

(87) PCT Pub. No.: WO98/44264

PCT Pub. Date: Oct. 8, 1998

(51) Int. Cl.[7] ..... F01L 25/02

(52) U.S. Cl. ..... 91/304; 91/308; 91/314

(58) Field of Search ..... 91/218, 271, 272, 91/304, 308, 314

(56) References Cited

U.S. PATENT DOCUMENTS

| | | | | |
|---|---|---|---|---|
| 2,884,860 | * | 5/1959 | Ellis et al. | 91/314 X |
| 3,651,642 | | 3/1972 | Bauch et al. . | |
| 4,680,930 | * | 7/1987 | Dollison | 91/314 X |

FOREIGN PATENT DOCUMENTS

| | | |
|---|---|---|
| 1 500 537 | 6/1969 | (DE) . |
| 1 450 878 | 7/1969 | (DE) . |
| 1 904 811 | 9/1969 | (DE) . |

* cited by examiner

*Primary Examiner*—Hoang Nguyen
(74) *Attorney, Agent, or Firm*—Larson & Taylor PLC

(57) ABSTRACT

A control system of a pneumatic oscillation cylinder (1) to produce the oscillating motion of a scraper (3) used in paper machines in particular. There is in the oscillation cylinder motion rod (18) motion stoppers (4), which in both wanted reversing points of the rod (18) motion open an own pressure discharge valve (5) for the said stopper in the pilot operation line (9), whereby the opening of both pressure discharge valves (5) in turns causes a reversing function in a pneumatic reversing valve (10) known as such.

5 Claims, 3 Drawing Sheets

CONTROL SYSTEM FOR AN OSCILLATION CYLINDER

The invention relates to a control system of a pneumatic oscillation cylinder by means of which the cylinder carries out linear motion and the length and speed of whose oscillation motion are easily adjusted.

Previously known is a control system of a pneumatic oscillation cylinder by means of which a paper machine scraper is moved and where the pneumatic cylinder to-and-from motion is produced by means of a reversing valve connected to the pneumatic line. The reversing valve is controlled by means of pressure difference obtained from the system. In this known design the air stream that leaves the piston-pushed cylinder is slightly choked in order to get overpressure into the outlet line. When the piston and the piston rod arrive at a wanted reversing point, the rod or an additional part fixed to it hits an obstruction and the piston motion stops. Almost immediately this causes reduction of overpressure from the outlet line. Reduction of overpressure is utilised for moving the piston of the pneumatic valve so that reversing takes place. Same procedure is applied in both piston-reversing points. In the most simplified case the piston hits the cylinder ends, whereby neither external obstructions nor stoppers are needed. Neither can the oscillation length then be adjusted,.

In the praxis the solution has turned out quite inconvenient, since the pressure difference controlling the reversing valve changes at once when, for instance, the oscillation speed is changed in adjusting the working pressure. On the other hand, if striving to adjust the speed of motion in keeping the working pressure unchanged, a corresponding situation, where the pressure difference changes, is also achieved. The adjustment will also become complicated, since many chokers that effect one another must be adjusted.

In the above design the working pressure must all the time remain on a level corresponding approximately to the adjustment or higher, otherwise the cylinder motion stops, since there will then be no pressure difference necessary for the reversing valve.

In known solutions the weakness is the delay occurring also in the reversing points, which is due to the not-fast-enough drop of overpressure on the piston outlet side when the piston stops, since overpressure is discharged through an adjustable choke valve. A further disadvantage is that the piston hits the cylinder end or the piston rod hits an obstruction, which may cause a swing of the scraper and thus a scraping error.

By means of a control system as per this invention easy control, fast and jerk-free passing of the reversing points is achieved as well as a system not sensitive to working pressure variations. In conducting the streams of discharge pressure air into the box around the device an overpressure state in the box is produced and the equipment made applicable to severe conditions, in connection with a paper machine, for instance. The invention is characterized in what is presented in the patent claims.

In the following the invention is disclosed with reference to the enclosed drawing, where FIG. 1 is a schematic view of the oscillation cylinder control system.

Figure 1:
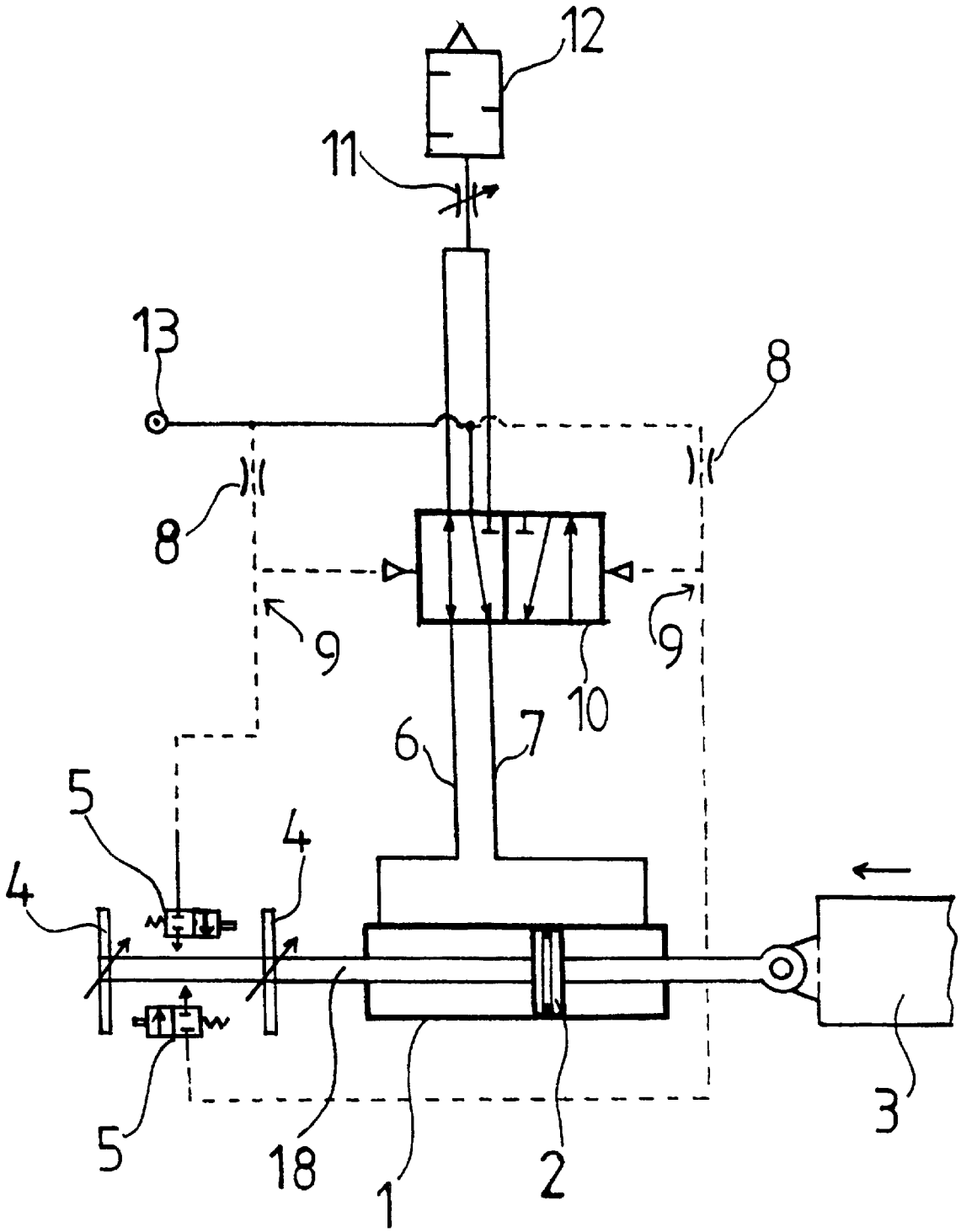

FIG. 1 is a pneumatic oscillation cylinder 1 with a built-in piston 2 and piston rod 18. Rod 2 moves out from both cylinder ends. To the rod a movable scraper 3 belonging to the paper machine is fixed. In rod 18 there are motion stoppers 4 that can be fixed by set screws into different positions on the rod. They are, for instance, discs, if the piston rod can rotate by oscillation. Both motion stoppers are furnished with spring-loaded discharge valves 5 allowing pressure discharge from line 9, when stoppers 4 hit their stem. Adjustment of the motion stoppers location, i.e. adjustment of the oscillation length, is quickly carried out. Most suitably the discharge valves are fixed to the body of cylinder 1.

Working pressure for the equipment comes along line 13 and is conducted both to the reversing valve 10 inlet and pilot operation lines 9 through chokers 8. As choker works for instance an opening with a diameter of 0.4 mm. The reversing valve 10 is a pneumatically operated valve block known as such and its stem moves to-and-from depending on the direction of the pressure difference between lines 9. From cylinder 1 there are pressure lines for valve 10 and also outlet lines for choker 11 and for exhaust muffler 12. Choker 11 is adjustable and used for adjustment of oscillation speed.

Figure 2:
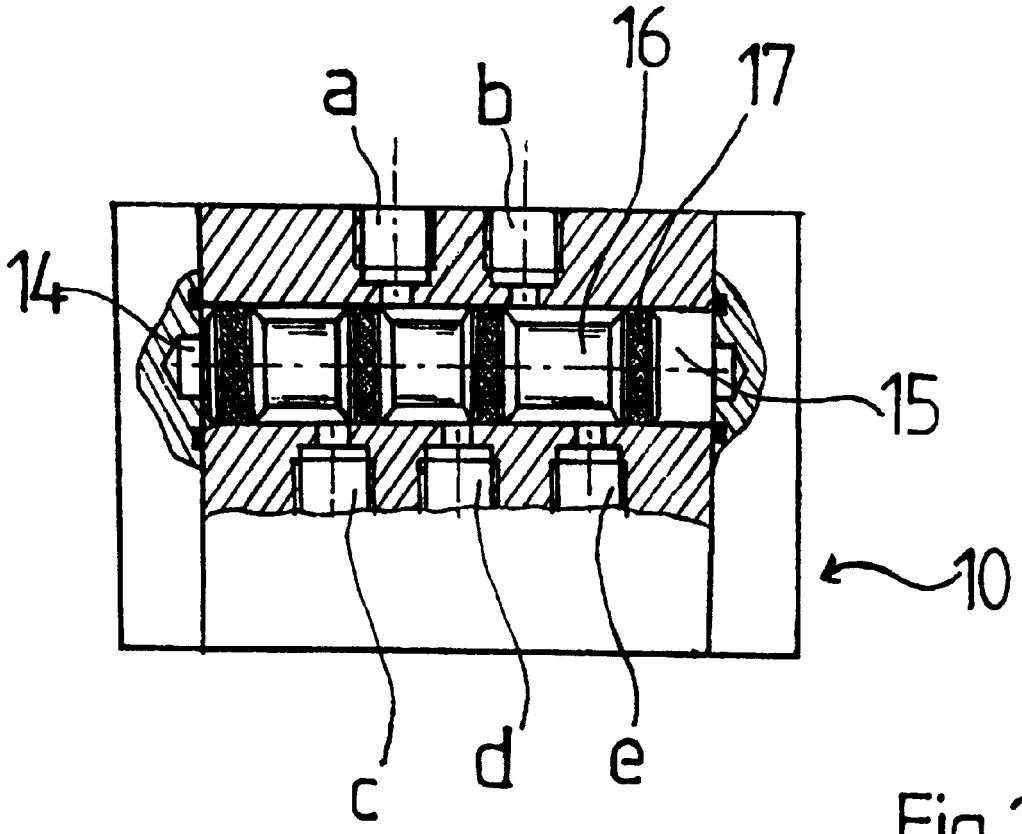
FIG. 2 is a partial section of the reversing valve.

In the scheme in FIG. 1 the piston is moving to the left and likewise the motion stoppers in rod 18. In lines 9 same pressure prevails and no transmitting power is then effecting stem 16 of valve 10 (FIG. 2). When stopper 4 hits the stem head of discharge valve 5, pressure is discharged from the corresponding line 9, because enough compensating pressure air cannot come through choker 8. The pressure difference produces a force into valve 10 that moves stem 16 to reversing position. In this stem 16 position the pressure line becomes the outlet line and vice versa. Then piston 2 moves in the opposite direction. After a slight move of piston 2 discharge valve 5 reverts to closed status and into lines 9 a working pressure of equal size is formed. This condition prevails till another stopper 4 hits the stem of corresponding discharge valve 5 and stem 16 of valve 10 reverts to the other side due to pressure difference now produced in the other direction. When discharge valve 5 opens there is fast pressure discharge from line 9, faster than in the previously known solution, where discharge of slight overpressure takes place through the choke valve.

In this way there will be no break of motion in the reversing points and no shock by collision, since the collision of stoppers 4 with the stem of discharge valves 5 does not have any impact on the motion of the piston and piston rod, when taking their mass into consideration.

FIG. 2 shows a pneumatic reversing valve 10. The pilot pressures from lines 9 are conducted into chambers 14,15 in both ends of stem 16. The stem glides in a cylinder formed inside the valve and opens and closes channels a–e in order to change the coupling. The stem has washers 17 gliding in the cylinder and thus being slightly stressed and long-lived.

Working pressure is fed from gate d in turns to gates a or b, from there pressure lines continue to cylinder 1. Lines, which can also be connected with each other, start from grates c and e to choker 11.

The control system will work even by sudden drop of working pressure, the oscillation starts moving always when there is enough working pressure to move the scraper, for instance. For speed regulation the adjustment of choker 11 alone is sufficient with no effect on the other functions. In the cylinder the piston turns in both ends on an air cushion without any mechanical contacts.

The equipment can be a compact properly encased construction for severe conditions, for instance connected to a paper machine, whereby it is possible to keep the box around the construction under overpressure by means of escaping air streams.

Figure 3:
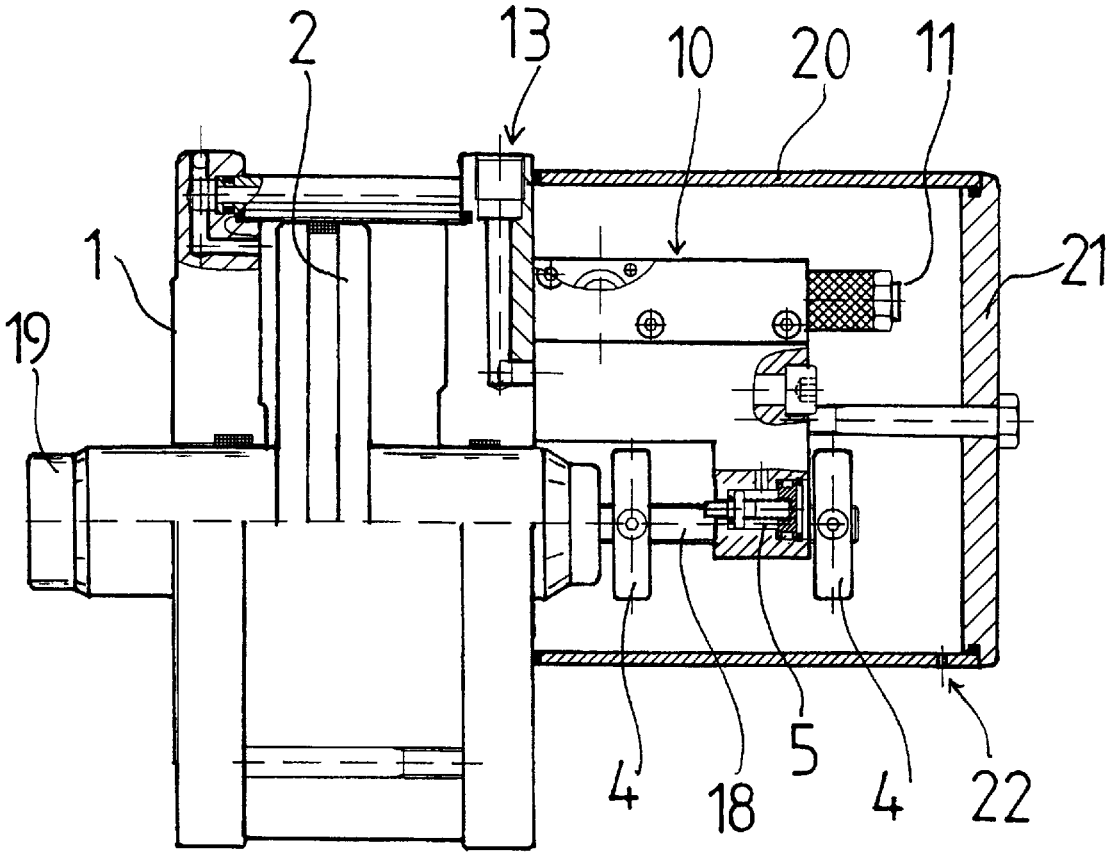
FIG. 3 is a partial section or a complete section of the cylinder, the valves and the box.

FIG. 3 shows one construction of this kind, where the reference numbers correspond to the equivalent reference numbers of FIG. 1. Valves 10, valves 5, the extruding head of shaft 18 with adjusting discs 4 on it are inside the box construction 20,21. In FIG. 3 one valve 5 is shown on shaft 18 front side and the other valve 5 behind the said valve.

From the box there is a small discharge opening 22 out. The other shaft end 19 extrudes from cylinder 1, in the end of which the movable part is fixed. Similar working pressure influences both sides of piston 2 and the piston cross-sections are the same on both sides. Powers moving piston 2 become symmetrical. In this case the discharge channels from cylinder 1 can be collected together and so only one choker 11 is needed. The counter pressure on both piston sides is the same during the working motion in both directions.

Pressure discharge is substantially continuous, since all the time the air stream is discharged from choke valve 11 to the box and further in turns from valves 5 when the piston is in the reversing points.

What is claimed is:

1. A control system of a pneumatic oscillation cylinder (1) to produce the oscillating motion of a scraper (3) used in paper machines and to adjust the length and speed of the said motion, whereby there is in the oscillation cylinder motion rod (18) motion stoppers (4) adjustable with regard to their position, which in both of the wanted reversing points of the rod (18) motion open an own pressure discharge valve (5) for the stopper in the pilot operation line (9), whereby opening both pressure discharge valves (5) in turns causes a reversing function in the pneumatic reversing valve (10) known as such, which conducts working pressure to the oscillation cylinder (1) characterized in that the piston rod (18) of cylinder (1) reaches through the cylinder symmetrically in order to produce the symmetrical to-and-from motion, and that the valves and motion stoppers are inside an encased construction (20,21), whereby the box (20,21) is kept under overpressure at least by means of air streams escaping through valves (5).

2. A control system according to patent claim 1 characterized in that air streams escaping from oscillation cylinder (1) are conducted into box construction (20,21) to maintain overpressure.

3. A control system according to patent claim 1 characterized in that for adjustment of the motion speed there is in a channel leading out of cylinder (1) a choker 11 through which the air stream is discharged into box (20,21).

4. A control system according to patent claim 1 characterized in that working pressure is conducted to the pilot operation line (9) of valve (10) through chokers (8) in order to produce a sufficient drop of pressure in the pilot operation line when discharge valve (5) is opened by stopper (4).

5. A control system according to any of the patent claim 1 characterized in that the pressure discharge from valves (5,11) to the said box is substantially continuous.

* * * * *